US005455652A

United States Patent [19]

Earle et al.

[11] Patent Number: 5,455,652

[45] Date of Patent: Oct. 3, 1995

[54] PHOTOGRAPHIC TRANSPORT MECHANISMS

[75] Inventors: Anthony Earle, Harrow Weald; George R. Dickens, Pinner, both of United Kingdom

[73] Assignee: Eastman Kodak Company, Rochester, N.Y.

[21] Appl. No.: 121,627

[22] Filed: Sep. 15, 1993

[30] Foreign Application Priority Data

Sep. 17, 1992 [GB] United Kingdom ..... 9219664

[51] Int. Cl.[6] ..... G03D 3/08

[52] U.S. Cl. ..... 354/319; 354/339; 354/340; 226/91

[58] Field of Search ..... 354/319–322, 354/339, 340, 345; 226/91, 92, 170, 189, 171; 24/344; 250/475, 476; 355/75; 271/33; 134/64 P, 122 P, 64 R, 122 R; 242/332.4, 33, 564, 528; 429/127

[56] References Cited

U.S. PATENT DOCUMENTS

| | | | |
|---|---|---|---|
| 3,127,079 | 3/1964 | Allander | 226/92 |
| 3,810,568 | 5/1974 | Kwiaikowski et al. | 226/92 |
| 4,065,042 | 12/1977 | Zielinski | 354/324 X |
| 4,140,383 | 2/1979 | Schmidt | 134/64 P |
| 4,181,859 | 1/1980 | Vitalini | 250/476 |
| 4,188,108 | 1/1980 | Falomo | 354/345 |
| 4,286,869 | 9/1981 | Kogane | 355/75 |
| 4,330,191 | 5/1982 | Rawlings et al. | 354/345 |
| 4,531,689 | 7/1985 | Beach, Jr. et al. | 226/91 X |
| 4,550,883 | 11/1985 | Boss | 242/528 |
| 4,576,321 | 3/1986 | Marson | 24/344 X |
| 4,609,161 | 9/1986 | Weyland, Jr. | 242/564 |
| 4,613,222 | 9/1986 | Takase et al. | 354/321 |
| 4,773,580 | 9/1988 | Schweiger | 226/92 |
| 4,821,060 | 4/1989 | Kirths | 354/321 |
| 4,853,730 | 8/1989 | Kurths | 354/340 |
| 4,916,036 | 4/1990 | Cheiky | 429/127 |
| 4,929,976 | 5/1990 | Cunningham et al. | 354/322 |
| 5,060,009 | 10/1991 | Milovanovich | 271/33 X |

FOREIGN PATENT DOCUMENTS

| | | | |
|---|---|---|---|
| 59-121334 | 7/1984 | Japan | 354/319 |
| 57-185041 | 11/1992 | Japan | 354/319 |

*Primary Examiner*—D. Rutledge
*Attorney, Agent, or Firm*—Frank Pincelli

[57] ABSTRACT

It is well known to attach clips carrying photographic material to a belt for transport through processing apparatus. However, known clips have the disadvantage of distorting the belt to which they are attached which eventually leads to belt damage. Described herein is an improved belt/clip arrangement in which 'Velcro' material is utilized to provide the releasable attachment. A belt (10) carries a plurality of patches (12) which comprise hook material. A clip (26) carries the corresponding loop material and is pressed firmly to the belt (10) so that at least two of the patches (12) are covered by the clip (26). The clip (26) can be detached from the belt (10) by positioning a wedge to pass between the clip (26) and the belt (10) or alternatively, the belt (10) may be passed over a tight radius to effect detachment.

3 Claims, 2 Drawing Sheets

PHOTOGRAPHIC TRANSPORT MECHANISMS

FIELD OF INVENTION

This invention relates to photographic transport mechanisms for transporting photographic material through photographic processing apparatus.

BACKGROUND OF THE INVENTION

It is well known to transport photographic material through multi-strand processing apparatus by attaching the material to a transport belt. In these instances, the belt is endless and allows the operators of such apparatus to thread new rolls of material through the apparatus without disturbing or spoiling webs already running.

Multi-strand processing apparatus are used by larger photo-finishers because of their ability to handle more than one roll of material at a time. As rolls finish, new rolls are put on to the apparatus in their place and their leading edge is folded around a clip. This clip has a grip at one end which can be firmly fixed to a moving transport belt to pull the material through the apparatus. When the clip reaches the wind up end of the apparatus, the clip is disengaged and the operator attaches the free end to a wind up core.

The simplest and most common clip relies on the fact that the belt is stiff exerting an outward force on the clip grippers. This has major disadvantages, namely, that is it difficult to attach the clip to the belt, and unclipping is achieved by pushing a wedge between the belt and the clip so that the clip is levered off. Examples of such clips are described in U.S. Pat. Nos. 4,188,108, 4,853,730, 4,821,060, and 4,773,580.

U.S. Pat. No. 4,188,108 describes a clip device which comprises a bar to which photographic material is connected, a hook at one end of the bar for hooking on to a flat conveyor belt, and a resilient clip fixed to the bar at a distance from the hook which clamps on to the conveyor belt. The bar has a slot formed therein for reception of the material and a further clip pivotally attached to the bar is used to retain the material in the slot. In this arrangement, the conveyor belt runs alongside the material to be processed.

U.S. Pat. No. 4,853,730 discloses photographic developing apparatus which has an elastic conveyor belt and at least one clamp which is designed to be mounted on the conveyor belt to engage a strip of photographic material. The clamp has spaced gripping elements which define an opening of width less than that of the conveyor belt and are arranged to engage the marginal portions of the belt. A mechanism for mounting the clamp on the belt is also disclosed.

U.S. Pat. No. 4,821,060 describes another clamp arrangement. A web of photographic material is connected to a running band, which serves to pull the web through processing apparatus, the connection being provided by a clip. One portion of the clip is separably connected to the web and another portion is provided with a channel into which the band is positioned by reducing its effective width.

U.S. Pat. No. 4,773,580 also discloses a clip arrangement which can be coupled to an elastic belt conveyor. The clip has a slotted arm portion into which photographic material is inserted, and a frame portion for receiving the elastic belt. The frame portion is sized so that the belt buckles to reduce its effective width when inserted inside the frame portion.

In all of these clip arrangements, the belt needs to be distorted where a clip is attached to the belt in order to provide the gripping necessary for allowing transport of the material through processing apparatus. This distortion causes the belt to quickly lose its resilience and causes it to crack and possibly break.

SUMMARY OF THE INVENTION

It is therefore an object of the present invention to provide a transport mechanism in which there is no distortion of the belt when retaining clips are attached to it.

According to one aspect of the present invention, there is provided a transport mechanism for transporting photographic material through photographic processing apparatus, the mechanism comprising:

a transport belt for transporting the material through the apparatus;

at least one clip for retaining an end of the material as it is transported through the apparatus; and attachment means for releasably attaching each clip to the belt;

characterized in that the attachment means comprises a two-part push-together connection, a first part being carried by the belt and a second part being carried by each clip.

By this arrangement, the belt does not suffer from the fatigue due to distortion as encountered with the prior art arrangements as a part of the connection is permanently fixed to the belt.

The present invention also has the advantage of providing ease of attachment of the clips to the belt without distortion the belt.

For a better understanding of the present invention, reference will now be made, by way of example only, to the accompanying drawings in which:

DESCRIPTION OF THE PREFERRED EMBODIMENTS

Figure 1:
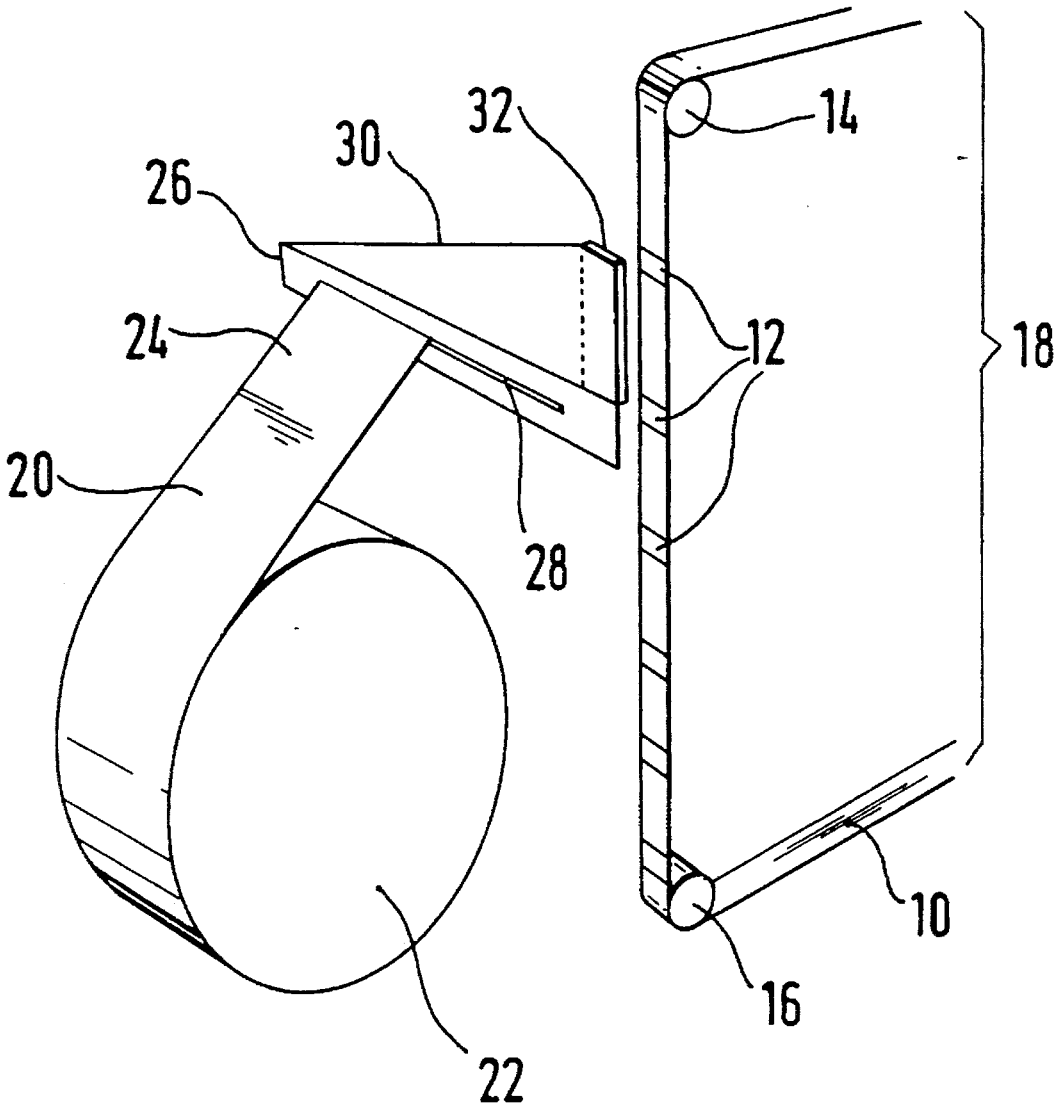
FIG. 1 illustrates a transport mechanism in accordance with the present invention at a roll unwind station in photographic processing apparatus.

In FIG. 1, an endless thread up belt 10 is shown. The belt 10 has a plurality of patches 12 fixed to it along its length (only some of the patches 12 are shown for clarity). The patches 12 comprise 'Velcro' hook material. ('Velcro' is a trade mark.)

The belt 10 passes around rollers 14, 16. The region between rollers 14 and 16 defines a roll unwind station 18 where photographic material 20 in roll form is unwound from its core 22. The belt 10 passes vertically through the unwind station 18 as shown.

After passing through the unwind station 18, the belt 10 runs on to a processing stage (not shown), where it travels through tanks containing appropriate processing solutions (not shown), to drive or winding means (not shown) and then back to the unwind station 18.

Photographic material 20 is positioned at the unwind station 18 and a leading edge 24 is attached to a thread up clip 26. The leading edge 24 is fed through a slot 28 formed in the clip 26 and folded over. Retaining means (not shown) may be used to retain the leading edge 24 in its folded position in the clip 26.

The clip 26 comprises a bracket portion 30 which is attachable to the belt 10 so that the photographic material 20 can be pulled through the processing solutions. On an edge 32 of the bracket portion 30, a patch of 'Velcro' loop material is fixed. This patch engages patches 12 on the belt 10 to releasably attach the clip 26 to the belt 10. The bracket portion 30 transmits pulling forces from the belt 10 to the photographic material 20 and prevents the 'Velcro' loop material from being twisted off the hook material 12.

Prior to pulling the leading edge 24 of the photographic material 20 through the apparatus (not shown), the bracket portion 30 carrying the 'Velcro' loop material is firmly pressed to the belt 10 so that it covers at least two of the patches 12.

Figure 2:
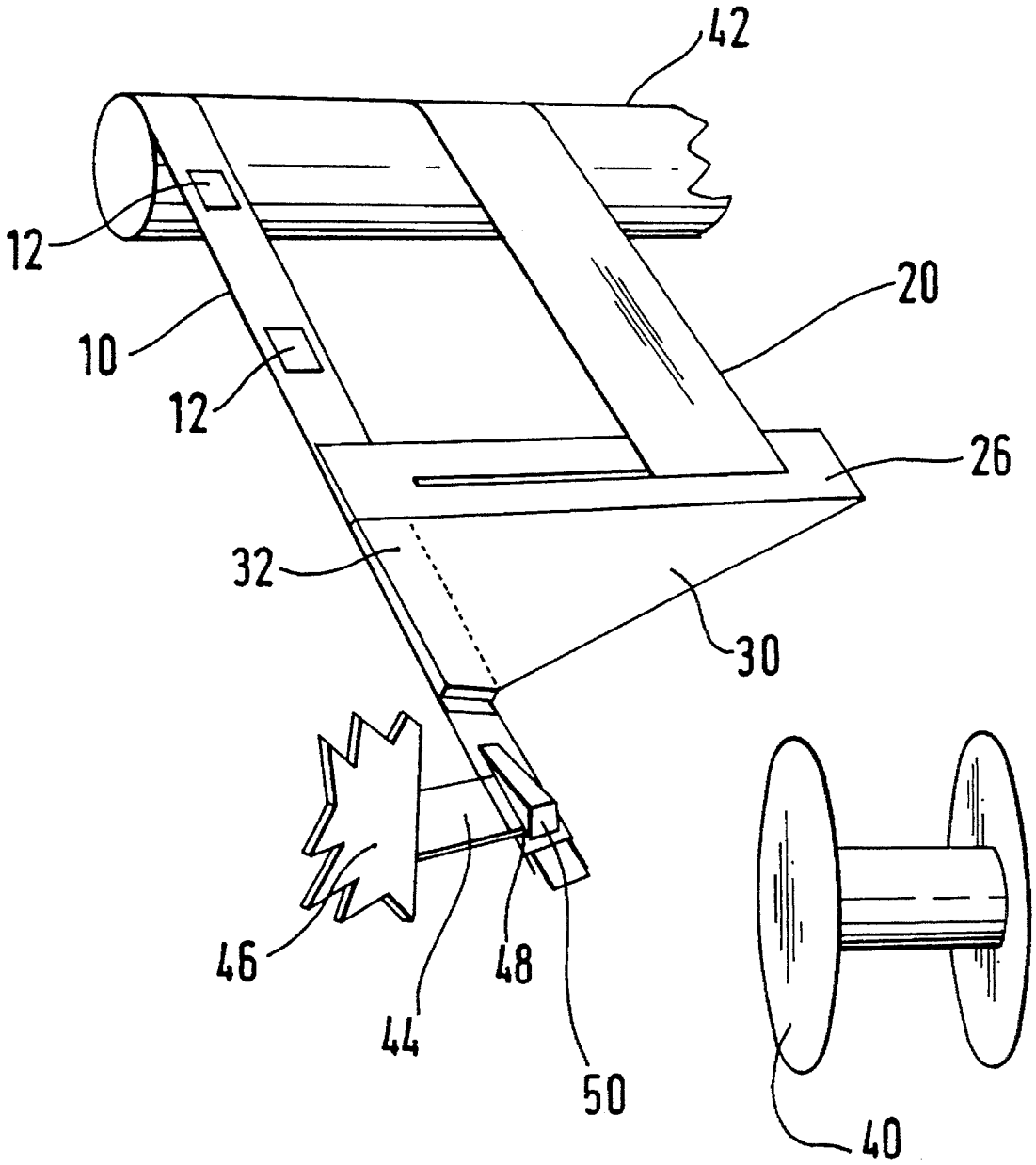
FIG. 2 illustrates the transport mechanism according to the present invention at a roll winding station in photographic processing apparatus.

FIG. 2 illustrates a roll winding station where photographic material 20 emerges from the processing tanks after being pulled therethrough by the belt 10 and clip 26 is wound on to a core 40. The photographic material 20 is shown passing over the last roller 42 in the processing stage.

A bracket 44 is attached to a frame portion 46 of the apparatus (not shown) and extends therefrom into the path of the belt 10. At its end 48 remote from the frame portion 46, the bracket 44 carries a wedge 50. The wedge 50 passes between the patches 12 comprising the hook material and the loop material carried by edge 32 of bracket portion 30 of the clip 26 to effect separation of the clip 26 from the belt 10. The material 20 can then be unfolded from the clip 26 and fixed to the core 40 for winding up.

Instead of the hook material being carried by the belt 10, it may be carried by the clip 26. In this case, the belt 10 will carry the loop material.

Alternatively, the patches 12 on the belt 10 may be replaced with a continuous strip of material, either comprising hook or loop material as desired.

Instead of providing wedge 50 at the end 48 of bracket 44, the belt 10 could be passed over a tight radius so that the clip 26 and belt 10 are separated.

The transport mechanism according to the present invention has the advantage that it can be easily implemented without major modification to existing processing apparatus. Furthermore, wear and tear on the belt is substantially eliminated, and existing belts can be modified by the addition of the 'Velcro' material.

Apart from the known 'Velcro' material comprising hook material and loop material, any other similar material could also be used provided the releasable attachment is provided. For example, the material may comprise studs on both parts, one part having a different stud spacing to the other.

It may be possible to utilize a magnet arrangement to carry out the same function as the 'Velcro'.

What is claimed is:

1. A transport mechanism for transporting photographic material through photographic processing apparatus, the mechanism comprising:

a transport belt for transporting the material through the apparatus;

at least one clip for retaining an end of the material as it is transported through the apparatus; and attachment means for releasably attaching each clip to the belt;

characterized in that the attachment means comprises a two-part push-together connection, a first part being carried by the belt and a second part being carried by each clip, said first and second parts each comprising a piece of Velcro-like material.

2. A mechanism according to claim 1, wherein the first part carried by the belt is continuous.

3. A mechanism according to claim 1, wherein the first part carried by the belt comprises a plurality of individual spaced apart portions.

* * * * *